US007127075B2

(12) United States Patent
Park

(10) Patent No.: US 7,127,075 B2
(45) Date of Patent: Oct. 24, 2006

(54) ACOUSTIC VIBRATION SYSTEM WITH SPEAKER FOR AIR MATTRESSES

(76) Inventor: Yang Sung Park, #206-1303 Ssangyong Apt., Changshin 3-dong, Jongro-gu, Seoul, 110-771 (KR)

( * ) Notice: Subject to any disclaimer, the term of this patent is extended or adjusted under 35 U.S.C. 154(b) by 70 days.

(21) Appl. No.: 10/476,664

(22) PCT Filed: May 3, 2002

(86) PCT No.: PCT/KR02/00825

§ 371 (c)(1),
(2), (4) Date: Nov. 4, 2003

(87) PCT Pub. No.: WO02/089638

PCT Pub. Date: Nov. 14, 2002

(65) Prior Publication Data

US 2004/0136550 A1 Jul. 15, 2004

(30) Foreign Application Priority Data

May 4, 2001 (KR) ..... 2001-24235

(51) Int. Cl.
*H04R 25/00* (2006.01)

(52) U.S. Cl. ..... 381/151; 381/333; 5/904

(58) Field of Classification Search ..... 5/706, 5/729, 674, 666, 904; 381/151, 333, 162, 381/381

See application file for complete search history.

(56) References Cited

U.S. PATENT DOCUMENTS 4,507,816 A 4/1985 Smith, Jr.
5,442,710 A 8/1995 Komatsu
6,489,000 B1 * 12/2002 Ogura et al. ..... 428/45
6,493,888 B1 * 12/2002 Salvatini et al. ..... 5/423
6,568,011 B1 * 5/2003 Fisher et al. ..... 5/706

FOREIGN PATENT DOCUMENTS

| | | |
|---|---|---|
| JP | 06007238 | 1/1994 |
| JP | 12-83766 A | 3/2000 |
| KR | 97-5160 A | 2/1997 |
| WO | WO87-05497 A1 | 9/1987 |

* cited by examiner

*Primary Examiner*—Brian T. Pendleton
(74) *Attorney, Agent, or Firm*—John K. Park; Park Law Firm

(57) ABSTRACT

The object of the present invention is to provide an acoustic vibration system with a speaker for air mattresses. This vibration system includes an air mattress (20) consisting of a sealed body and inflated with air. One or more speakers (30) are mounted on the sealed body of the mattress, and are connected to an external audio system (31). The speakers (30) thus convert electrical energy outputted from the audio system (31) into sound energy, and radiate the sound energy into air inside the mattress (20), thus acoustically vibrating the mattress. In the vibration system, the sealed body of the mattress is made of a three-dimensional woven fabric (1) such that the sealed body has a desired durability and effectively resists expansion pressure. A coated layer is formed on the internal surface of the woven fabric (1) so as to prevent a flow of air through the fabric.

4 Claims, 6 Drawing Sheets

ACOUSTIC VIBRATION SYSTEM WITH SPEAKER FOR AIR MATTRESSES

TECHNICAL FIELD

The present invention relates to a system inducing the acoustic vibration of air mattresses, and more particularly, to an acoustic vibration system with one or more speakers for the air mattresses of beds, chairs or seats, where a sound-amplifying unit of the speaker is closely mounted on the sealed body of an air mattress and connected to an external audio system in order to acoustically vibrate the air mattress through the influx of acoustical energy to the mattress by dispersing the acoustical energy from the speaker, thereby making it possible to feel sounds through the body of a user in contact with the air mattress as well as enjoying music through the ears of the user.

PRIOR ART

Generally, a mattress for beds is a spring mattress, in which coil springs having elasticity are vertically and densely arrayed with uniform height, and a sponge or cushion is closely adhered to the upper and lower ends of the springs, which is entirely covered with a cover. Taking the effect of mattresses on the human body into consideration, such spring mattresses are focusing on a cushioning effect provided by the elasticity of the springs. When turning on an audio system, with a speaker connected thereto and installed on the surface of the spring mattress in a manner such that they face each other, the sponge layer absorbs sound energy radiated by the speaker, causing the sound to be vanished. It is thus impossible to transmit sound from the speaker to the other side of the mattress. With this regard, in order to radiate sound from a speaker closely mounted to one side of a mattress to acoustically vibrate the other, the inside of a mattress needs to contain a mediator capable of transmitting sound. The most preferable material used as such a mediator is air, through which sound can be transmitted effectively. A mattress filled with air has been already developed to be utilized mainly outdoors, but it has the drawbacks of absence of durability and low cushioning effect, and thus has a restricted application range, thereby causing difficulty when being applied to beds, widely used as household furniture.

On the other hand, an air mattress having advantages of the spring mattress may be, with reference to FIG. 4, prepared by forming a coating layer, capable of providing an air-sealing effect, to the inside or outside of a three-dimensional woven fabric in which lots of wires 'W' are placed between the upper fabric surface 2 and the lower fabric surface 3, and connect the two surfaces 2 and 3 together to maintain equilibrium of the mattress, and then being filled with compressed air, as disclosed in Korea Pat. No. 227665, which was proposed by the inventor of the present invention.

The air mattress made of such a three-dimensional woven fabric has cushion and buffering effects, as well as having the desired durability expected from the spring mattresses. In addition, when sound from a speaker is radiated to the surface of the mattress, it was found that vibration proportional to amplitude of the sound occurs, resulting from the mediation by air and wires connecting the upper and lower fabric surfaces.

DISCLOSURE OF THE INVENTION

Keeping the problems of the conventional spring mattress in mind, it is an object of the present invention to provide an acoustic vibration system with one or more speakers for air mattresses, where acoustical energy from the speakers is converted into vibrations which may be sensed through the body of a user, while innate function of the mattresses for beds is maintained.

In accordance with the present invention, there is provided an acoustic vibration system with one or more speakers for air mattresses, wherein the speakers connected to an audio system are installed at the external side surface of an air mattress, making it possible for sound to be transmitted from one side of the air mattress having the speakers to the opposite side, resulting in sound being sensed by the body of a user as well as the ears of the user when lying down or seating himself or herself on the mattress.

BEST MODES FOR CARRYING OUT THE INVENTION

The present invention will be explained in more detail with reference to the following embodiments in conjunction with the accompanying drawings. However, the following embodiments are provided only to illustrate the present invention, and the present invention is not limited to them.

Figure 1:
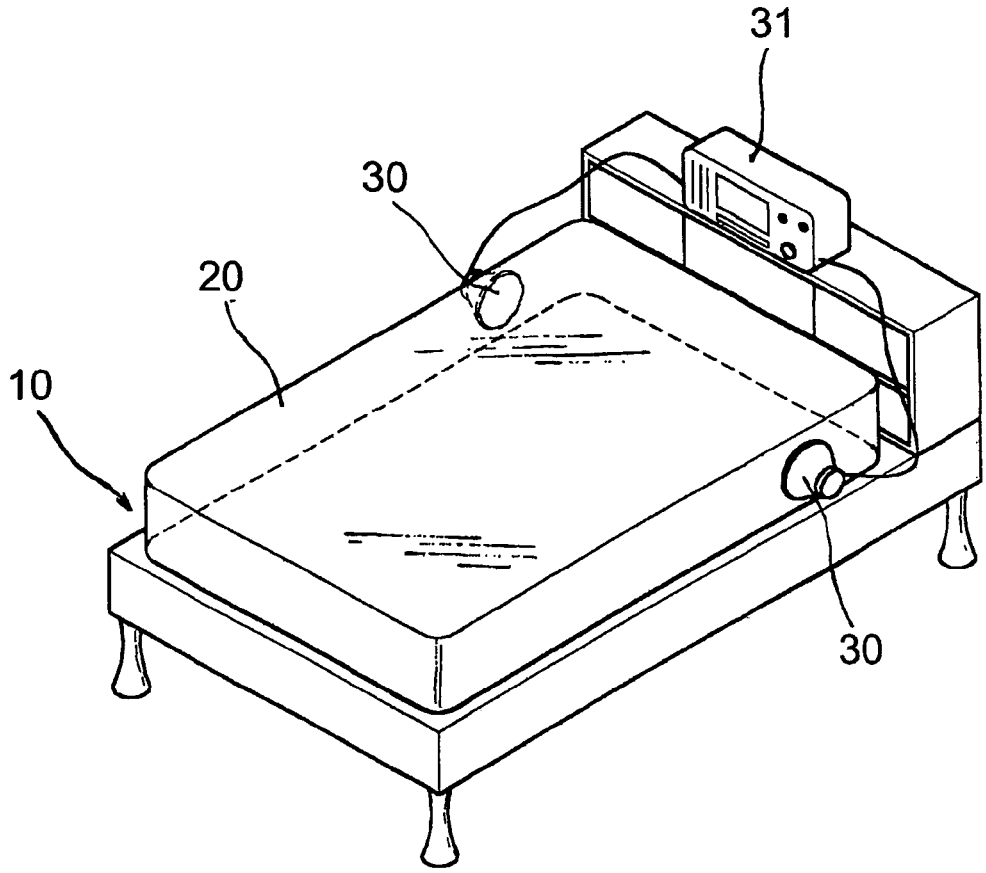
FIG. 1 is a perspective view showing an air mattress for beds, with speakers of the present invention installed on the air mattress.
Figure 2A:
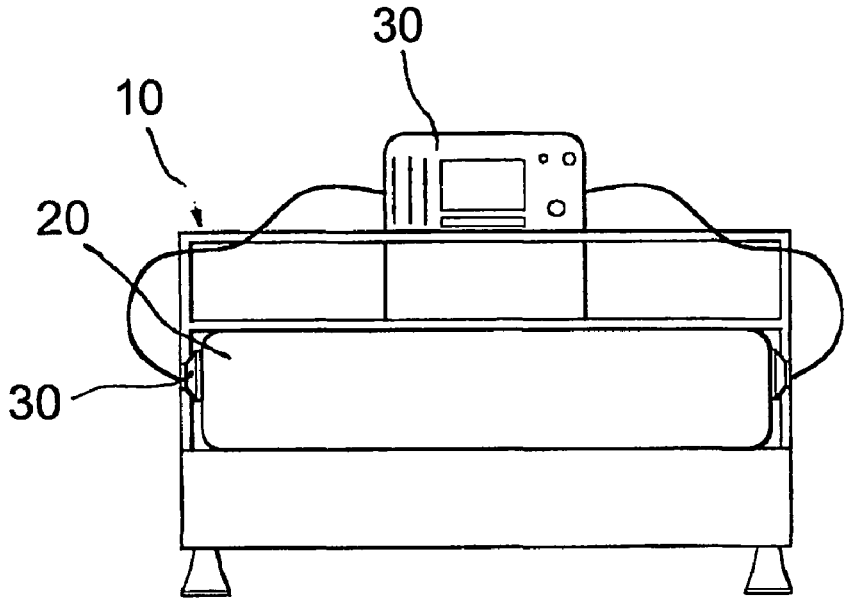
FIGS. 2A to 2C are views showing the speakers installed on the side and lower surfaces of the air mattress.
Figure 2B:
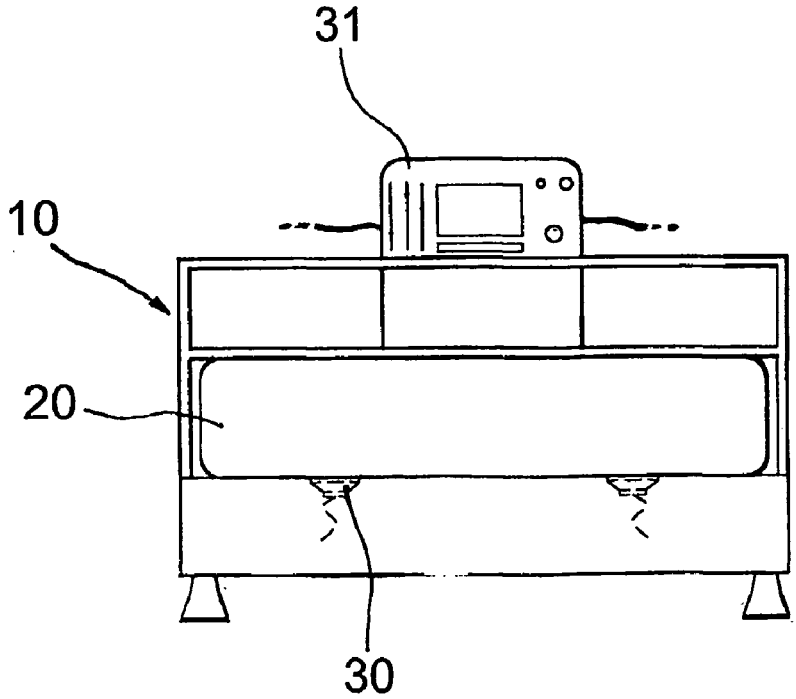

FIG. 1 is a perspective view showing speakers installed on an air mattress for beds, where the air mattress of the present invention is produced in a size similar to that of a general bed 10 and inflated with air to establish the same form as a conventional spring mattress, and FIGS. 2A to 2B are views showing the speakers installed in the side and lower surface of the air mattress.

Figure 4:
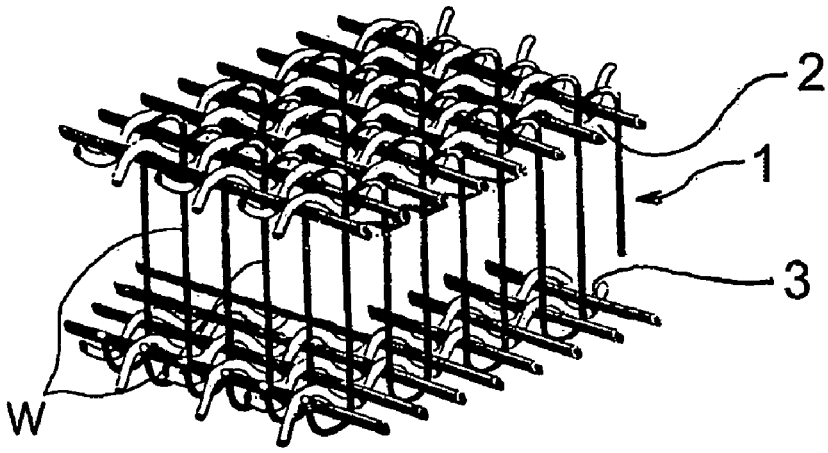
FIG. 4 is a perspective view showing the structure of the three-dimensional woven fabric for construciton of an air mattress.

The air mattress 20 of the present invention may be produced in a form of a rubber tube with one or a plurality of inlets for air injection. However, it is preferable to produce the air mattress 20 using a three-dimensional woven fabric 1 of FIG. 4. In order to produce the three-dimensional woven fabric 1, upper and lower fabric surfaces 2 and 3 are connected to each other by a great number of wires 'W' to form the fabric 1, with a coated layer formed on the inside or outside surface of the fabric 1 to accomplish an air-sealing effect as well as to maintain desired durability and resist air-expansion pressure.

When the air mattress 20 is placed on the bed 10, speakers 30 are preferably installed on the surface of the air mattress 20 at positions not negatively affecting a user. Thereafter, an external audio system 31 is connected to the speakers 30. When the audio system 31 is in operation, the acoustical signal from the audio system 31 is, through the speakers 30, regenerated in the form of sound waves, and the sound waves are radiated into the air inside the air mattress 20.

More preferably, the speakers 30 are installed at positions suitable for using the compressed air contained in the air mattress 20 as a mediator of vibration, as well as the body of the user laid on the air mattress 20 easily sensing vibration, that is, the opposite side surfaces or the lower surfaces of the air mattress 20, where the number of the speakers are, but not limited to, preferably about two.

Figure 2C:
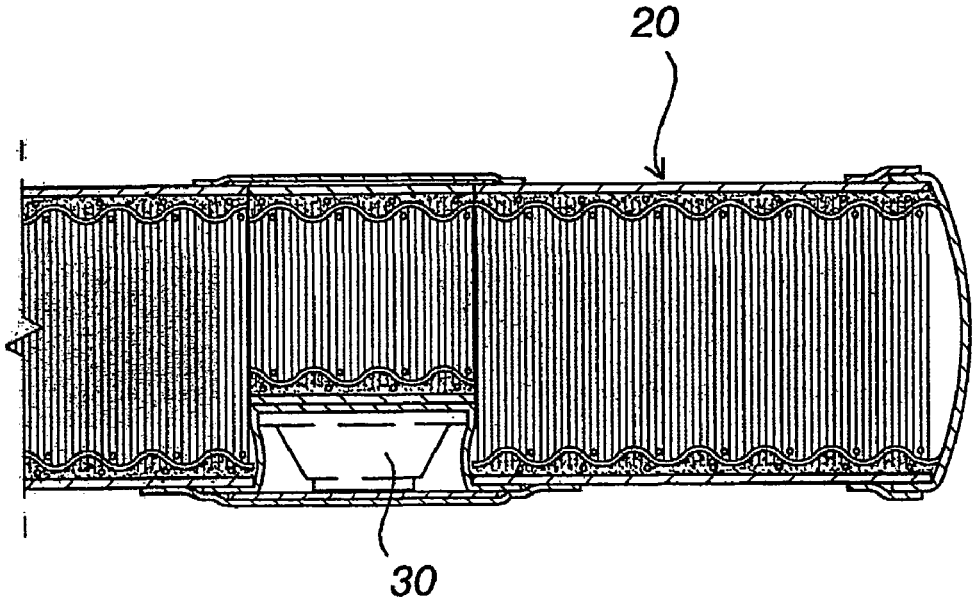

With reference to FIG. 2C, the speakers can be installed in such a way to be entirely inserted in depressed portions formed at the lower surface of the mattress 20.

Sound signals capable of developing acoustic vibration are preferably produced from a sound signal output terminal of a typical audio and video system (A/V system), and are amplified by an amplifier to produce sound in a range of audible frequencies.

In addition, it is possible to install an apparatus for regulating the strength of vibrations by increasing or decreasing it and an automatic air pumping apparatus increasing or decreasing the pressure of air in the mattress, thereby leading to vibration in stereo form, developed in the mattress 20 from irradiation of sound from the speaker 30.

Figure 3:
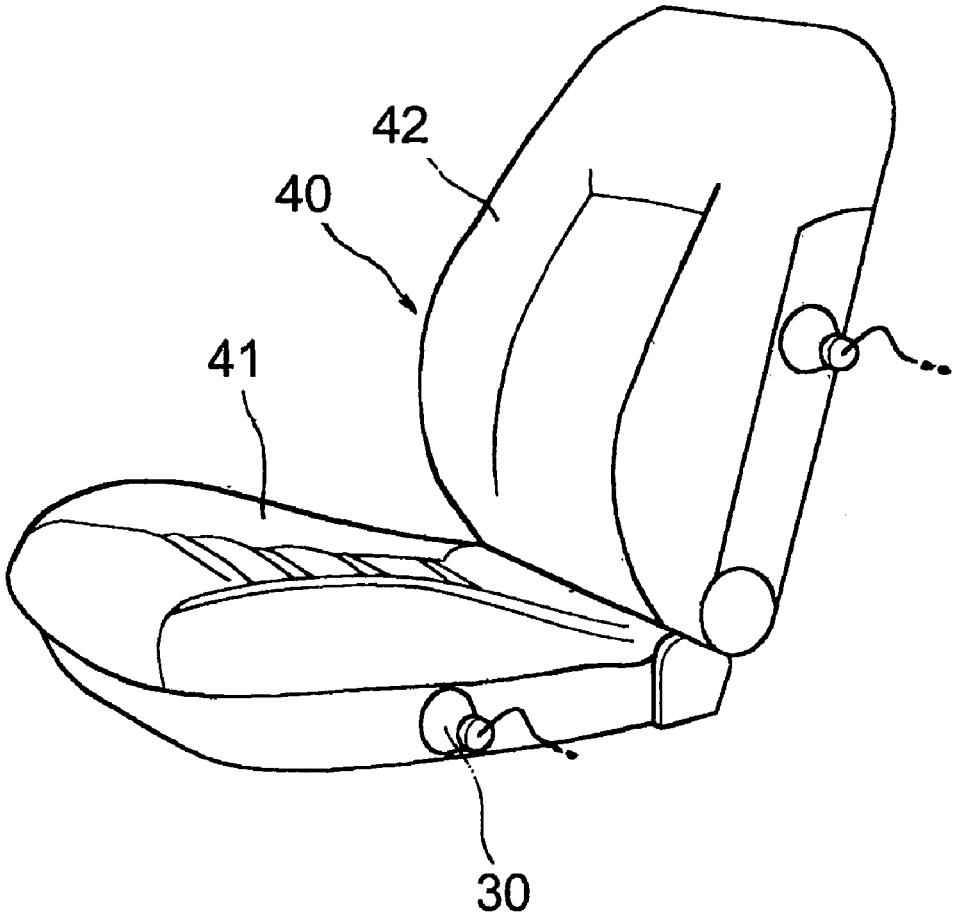
FIG. 3 is a perspective view showing an air mattress for seats of a car or airplane with speakers of this invention installed thereon.

With reference to FIG. 3, the air mattress with speakers of this invention may be used in the seats of a car or airplane. That is, the air mattress of the present invention may be preferably used in a seat 40 specifically designed for remaining seated for a long period of time, where a three-dimensional woven fabric may be also utilized for producing the mattress, just like the embodiment described above. The seat 40 is preferably divided into two parts, namely, a seating part 41 and a back-supporting part 42, and each of the two parts 41 and 42 is equipped with an independent speaker 30, which is connected to an audio system.

Therefore, once a user lies or takes a seat on an air mattress 20 placed on a bed 10 or the seat 40 and turns on the audio system 31, sound is then radiated into the mattress through the sound-amplifying units of the speakers 30 installed in the air mattress. The user experiences the sensation of vibrations, into which acoustical energy is converted, through his or her body, while listening to sound through his or her ears.

Figure 5A:
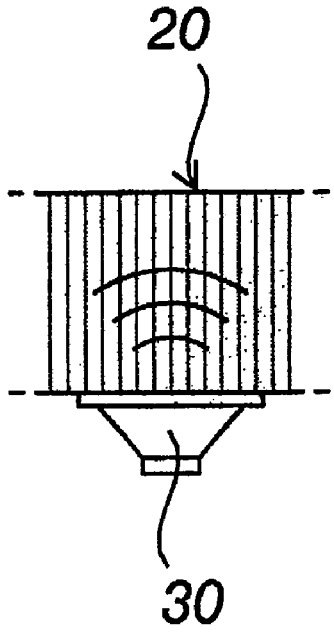
FIGS. 5A to 5C illustrate by three stages a principal of development of vibration at the opposite side of an air mattress when sound from a speaker radiates at one side of the mattress.
Figure 5B:
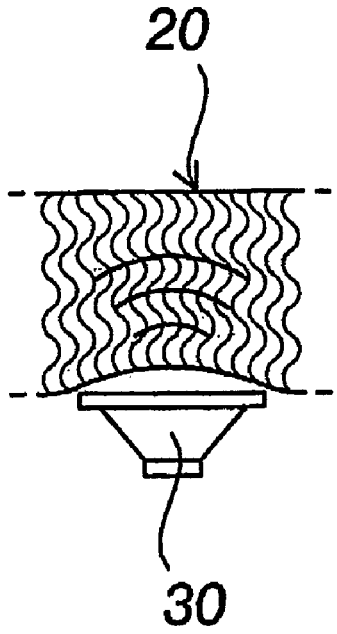
Figure 5C:
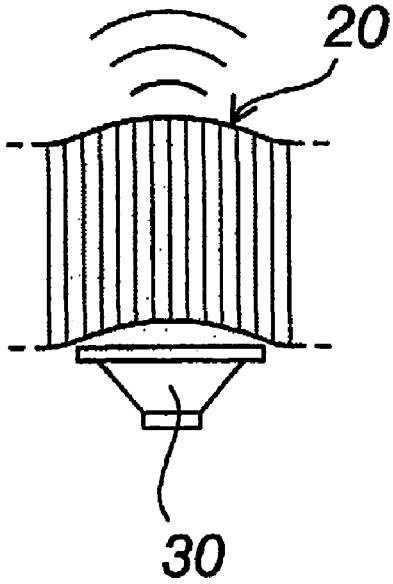

FIGS. 5A to 5C illustrate by three stages a principal of the development of vibration at the opposite side of an air mattress when sound waves from the speakers arrive at one of its sides. When sound waves from the speaker are radiated to the lower surface of the air mattress, compressed air and wires, which are contained in the air mattress, act as mediators to develop vibration at the opposite side. Such a transmission of vibration, mediated by the air and wires, is more effective than by air, only.

Therefore, when a user takes a break with listening to music, using the air mattress of the present invention, the user can feel sounds sensed through both his or her ears and body simultaneously, thereby giving a feeling of profundity of sound and close feeling of ambience.

INDUSTRIAL APPLICABILITY

As described hereinbefore, the acoustic vibration system for air mattresses of the present invention, where an air mattress is made of a three-dimensional woven fabric, and sound coming from a speaker connected to an audio system is installed on the external surface of the air mattress into which sound is radiated, is effective in deeply and mellowly feeling sound, thanks to feeling sound through ears of a user in addition to sensing amplitude of vibration proportional to that of sound sensed through the body of the user.

The invention claimed is:

1. An acoustic vibration system for air mattresses, comprising:

a) an air mattress consisting of a sealed body and inflated with compressed air to provide a predetermined level of cushioning effect, said sealed body of the air mattress being made of a three-dimensional woven fabric in which upper and lower fabric surfaces are vertically connected to each other by a plurality of wires such that the sealed body has a desired durability and effectively resists expansion pressure applied thereto, with a coated layer made of rubber and formed on an inside or outside surface of said upper and lower fabric surfaces, wherein the upper and lower fabric surfaces comprise a plurality of wefts and warps, wherein the wefts and warps are woven together with the wires whereby the three-dimensional woven fabric is provided, wherein the plurality of wires are pulled by the upper fabric surface and the lower fabric surface due to the pressure of the compressed air and are under tension; and b) a speaker mounted on the sealed body of the air mattress and connected to an external audio system, said speaker thus converting electrical signal energy output from the audio system into acoustical energy and radiating the acoustical energy into the air inside the air mattress, thus acoustically vibrating said mattress.

2. The acoustic vibration system according to claim 1, wherein one or more speakers are mounted on a lower surface of the sealed body of said air mattress.

3. The acoustic vibration system according to claim 1, wherein the acoustical energy from the speaker is transmitted through the wires which connect the upper and lower fabric surfaces to each other.

4. The acoustic vibration system according to claim 2, wherein the acoustical energy from the speaker is transmitted through the wires which connect the upper and lower fabric surfaces to each other.

* * * * *